US012083401B1

(12) United States Patent
Clark

(10) Patent No.: US 12,083,401 B1
(45) Date of Patent: Sep. 10, 2024

(54) SOCCER JUGGLING TRAINING NET

(71) Applicant: Eric Dick Clark, Powell, OH (US)

(72) Inventor: Eric Dick Clark, Powell, OH (US)

( * ) Notice: Subject to any disclaimer, the term of this patent is extended or adjusted under 35 U.S.C. 154(b) by 32 days.

(21) Appl. No.: 17/844,159

(22) Filed: Jun. 20, 2022

Related U.S. Application Data

(60) Provisional application No. 63/212,714, filed on Jun. 20, 2021.

(51) Int. Cl.
*A63B 69/00* (2006.01)
*A63B 63/00* (2006.01)

(52) U.S. Cl.
CPC ..... *A63B 63/004* (2013.01); *A63B 69/002* (2013.01); *A63B 2210/50* (2013.01); *A63B 2243/0025* (2013.01)

(58) Field of Classification Search
CPC ..... A63B 63/004; A63B 69/002; A63B 2243/0025
USPC ..... 473/446
See application file for complete search history.

(56) References Cited

U.S. PATENT DOCUMENTS 4,478,420 A 10/1984 Sowards
4,615,528 A 10/1986 York
5,280,922 A 1/1994 Jones
5,443,576 A 8/1995 Hauter
5,586,760 A 12/1996 Hauter
5,855,286 A * 1/1999 Zaid ..... A47K 5/12 211/85.7
6,220,974 B1 4/2001 Moore
6,398,040 B1 * 6/2002 Gregory ..... A63B 47/00 211/113
6,579,196 B1 6/2003 Yoon
D522,207 S * 5/2006 Gregory ..... D34/21
8,708,842 B2 4/2014 Ganuza
8,882,135 B1 * 11/2014 Chen ..... B62B 3/106 280/651
2019/0262685 A1 * 8/2019 Spelman ..... A63B 69/002

OTHER PUBLICATIONS

"PodiuMax's Soccer Juggling Net", YouTube Website, Web page <https://www.youtube.com/watch?v=aLHpEIWWrho>, 3 pages, dated Jul. 28, 2018, retrieved from www.youtube.com website on Jul. 9, 2022.

(Continued)

*Primary Examiner* — Mitra Aryanpour
(74) *Attorney, Agent, or Firm* — The Law Office of Patrick F. O'Reilly III, LLC

(57) ABSTRACT

A soccer juggling training net is disclosed herein. The soccer juggling training net includes a bottom net portion; a plurality of net side portions attached to the bottom net portion so as to define a semi-enclosed or enclosed space for juggling a soccer ball, the semi-enclosed or enclosed space constraining a movement of the soccer ball while a user is practicing the juggling of the soccer ball so as to obviate a need for a retrieval of the soccer ball by the user, but still providing sufficient freedom of movement of the soccer ball so as to permit effective juggling training by the user; and one or more support post members coupled to one or more of the plurality of net side portions, and configured to be inserted into the ground or into a base member so that the soccer juggling training net is maintained in a generally stationary position.

13 Claims, 14 Drawing Sheets

(56) References Cited

OTHER PUBLICATIONS

"Kids Training Soccer Ball—Size 3 Youth Smart Football with Tether for Juggling, Foot Control, Kicking Practice—Adjustable Cord—Outdoor Soccer Equipment", Amazon Website, Web page <https://www.amazon.com/Messi-Training-System-Kids-Soccer/dp/B081HZQ71V?th=1>, 9 pages, dated Nov. 18, 2019, retrieved from www.amazon.com website on Jul. 9, 2022.

"Sport-Thieme Ball Carrier", Sport-Thieme Website, Web page <https://www.sport-thieme.com/Balls/Ball_nets_and_ball_trolleys/Ball_trolleys/art=1308714>, 2 pages, dated at least as early as Jul. 22, 2020, retrieved from www.sport-thieme.com website on Jul. 9, 2022.

"3 Colors Sports Football Accessories Soccer Mesh Net Bag Single Ball Carrier For Carrying Basketball Volleyball Soccer", Ali Express Website, Web page <https://www.aliexpress.com/item/2251832764326165.html?gatewayAdapt=4itemAdapt>, 4 pages, dated at least as early as Jul. 22, 2020, retrieved from www.aliexpress.com website on Jul. 9, 2022.

"Soccer Ball Juggle Bags Children Auxiliary Circling Belt Kids Football Training Equipment Kick Solo Soccer Trainer Football Kick", DHGate Website, Web page <https://www.dhgate.com/product/soccer-ball-juggle-bags-children-auxiliary/539525821.html>, 10 pages, dated at least as early as Jul. 22, 2020, retrieved from www.dhgate.com website on Jul. 9, 2022.

* cited by examiner

Detail "A"

Detail "B"

SOCCER JUGGLING TRAINING NET

CROSS-REFERENCE TO RELATED APPLICATIONS

This patent application claims priority to, and incorporates by reference in its entirety, U.S. Provisional Patent Application No. 63/212,714, entitled "Soccer Juggling Training Net", filed on Jun. 20, 2021.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a soccer juggling training net. More particularly, the invention relates to a soccer juggling training net that constrains a movement of a soccer ball while a user is practicing the juggling of the soccer ball so as to obviate a need for a retrieval of the soccer ball by the user, but still providing sufficient freedom of movement of the soccer ball so as to permit effective juggling training by the user.

2. Background

Soccer is an explosive, fast-paced sport full of constant activity. In the middle of all that action, the ability to control the ball is crucial. Whether a player is moving the ball by dribbling, passing to or receiving a pass from a teammate, or taking a shot at the goal, coaches are constantly imploring players to have hundreds, if not thousands, of "touches" of the ball each day to develop ball control skill. Juggling is an essential training element in this endeavor. There are many ways juggling makes one a superior player, which include the following: (i) juggling improves "first touch" skill in quickly controlling the ball, (ii) juggling builds muscles and muscle memory for power and proper technique, (iii) juggling teaches good training habits for the future, (iv) juggling results in the improvement of receiving balls in the air, (v) juggling results in the improvement of passing balls in the air or off the bounce, (vi) juggling results in the improvement of volleys on goal, (vii) coaches will note juggling ability in tryouts, and (viii) juggling results in the overall raised confidence of the player.

Juggling is important, but it can also be very frustrating. Young players spend a lot of time chasing the ball around, and running into their fellow players without getting a lot of actual touches. Players can become discouraged and self-conscious at their lack of ability, and it can be a source of teasing and isolation. Others have tried to address this problem by attaching an elastic tether to the soccer ball, but the ball still tends to go all over and create frustration.

Therefore, what is needed is a soccer juggling training net that holds a soccer ball in a confined space while players develop their juggling skills. Moreover, a soccer juggling training net is needed that creates a defined space where a player can access and feel the ball through the net without the ball careening out of control on errant kicks. Furthermore, there is a need for a soccer juggling training net that allows players to improve their juggling ability, build muscle and proper muscle memory, and develop the touch required for superior passing, receiving, and volleying of a soccer ball.

BRIEF SUMMARY OF EMBODIMENTS OF THE INVENTION

Accordingly, the present invention is directed to a soccer juggling training net that substantially obviates one or more problems resulting from the limitations and deficiencies of the related art.

In accordance with one or more embodiments of the present invention, there is provided a soccer juggling training net that includes a bottom net portion; a plurality of net side portions attached to the bottom net portion so as to define a semi-enclosed or enclosed space for juggling a soccer ball, the semi-enclosed or enclosed space defined by the plurality of net side portions and the bottom net portion constraining a movement of the soccer ball while a user is practicing the juggling of the soccer ball so as to obviate a need for a retrieval of the soccer ball by the user, but still providing sufficient freedom of movement of the soccer ball so as to permit effective juggling training by the user; and one or more support post members coupled to one or more of the plurality of net side portions, the one or more support post members configured to be inserted into the ground or into a base member so that the soccer juggling training net is maintained in a generally stationary position relative to a support surface on which the soccer juggling training net is disposed.

In a further embodiment of the present invention, adjacent ones of the plurality of net side portions are joined to one another at approximately 90-degree angles, and the bottom net portion is joined to the plurality of net side portions at approximately 90-degree angles.

In yet a further embodiment, the one or more support post members comprise a plurality of support post members, each of the plurality of support post members being disposed in a respective corner of the soccer juggling training net.

In still a further embodiment, at least one of the plurality of support post members comprises a pointed tip so as to facilitate an insertion of the support post member into the ground.

In yet a further embodiment, at least one of the plurality of support post members comprises a post handle cap disposed on an upper end of the support post member so as to facilitate an insertion of the support post member into the ground.

In still a further embodiment, the soccer juggling training net further comprises a plurality of net support strips, each of the plurality of net support strips disposed in a respective one of the corners of the soccer juggling training net, each of the plurality of net support strips being disposed between and attached to adjacent net side portions, and each of the plurality of net support strips defining a passageway for receiving a respective one of the plurality of support post members.

In yet a further embodiment, the soccer juggling training net further comprises a plurality of net clip assemblies, each of the plurality of net clip assemblies configured to attach a respective one of the plurality of net support strips to respective adjacent net side portions.

In still a further embodiment, at least one of the plurality of net clip assemblies comprises a releasable locking mechanism for allowing one of the plurality of net support strips to be slid along the length of one of the plurality of support post members.

In yet a further embodiment, the one or more support post members are configured to be inserted a predetermined depth into the ground so as to define a gap between an upper surface of the ground and the bottom net portion, the gap allowing the user to kick the soccer ball from underneath the bottom net portion.

In still a further embodiment, the soccer juggling training net further comprises a base member for supporting the soccer juggling training net on a floor of a building, the base member comprising a plurality of side members connected to one another, one or more of the side members comprising holes disposed in upper surfaces thereof for enabling the one or more support post members to be inserted into the base member.

In yet a further embodiment, at least one of the plurality of side members of the base member defines a foot opening for allowing the user to kick the soccer ball from underneath the bottom net portion.

In still a further embodiment, the soccer juggling training net is configured to be collapsed into a compact state, and stowed in an elongate storage bag so that the soccer juggling training net is able to be easily transported and stored.

In yet a further embodiment, the soccer juggling training net further comprises a top net portion attached to the plurality of net side portions so as to define an enclosed space for juggling the soccer ball.

In still a further embodiment, the plurality of net side portions are attached to the bottom net portion by a plurality of hook members or a plurality of zip tie members.

In accordance with one or more other embodiments of the present invention, there is provided a soccer juggling training net that includes a bottom net portion; a net side portion attached to the bottom net portion so as to define a semi-enclosed or enclosed space for juggling a soccer ball, the semi-enclosed or enclosed space defined by the net side portion and the bottom net portion constraining a movement of the soccer ball while a user is practicing the juggling of the soccer ball so as to obviate a need for a retrieval of the soccer ball by the user, but still providing sufficient freedom of movement of the soccer ball so as to permit effective juggling training by the user; and one or more support post members coupled to the net side portion, the one or more support post members configured to be inserted into the ground or into a base member so that the soccer juggling training net is maintained in a generally stationary position relative to a support surface on which the soccer juggling training net is disposed, the bottom net portion being configured to be elevated a predetermined height above the ground or a floor surface so as to define a gap between the ground and the bottom net portion or a gap between the floor surface and the bottom net portion, the gap allowing the user to kick the soccer ball from underneath the bottom net portion.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
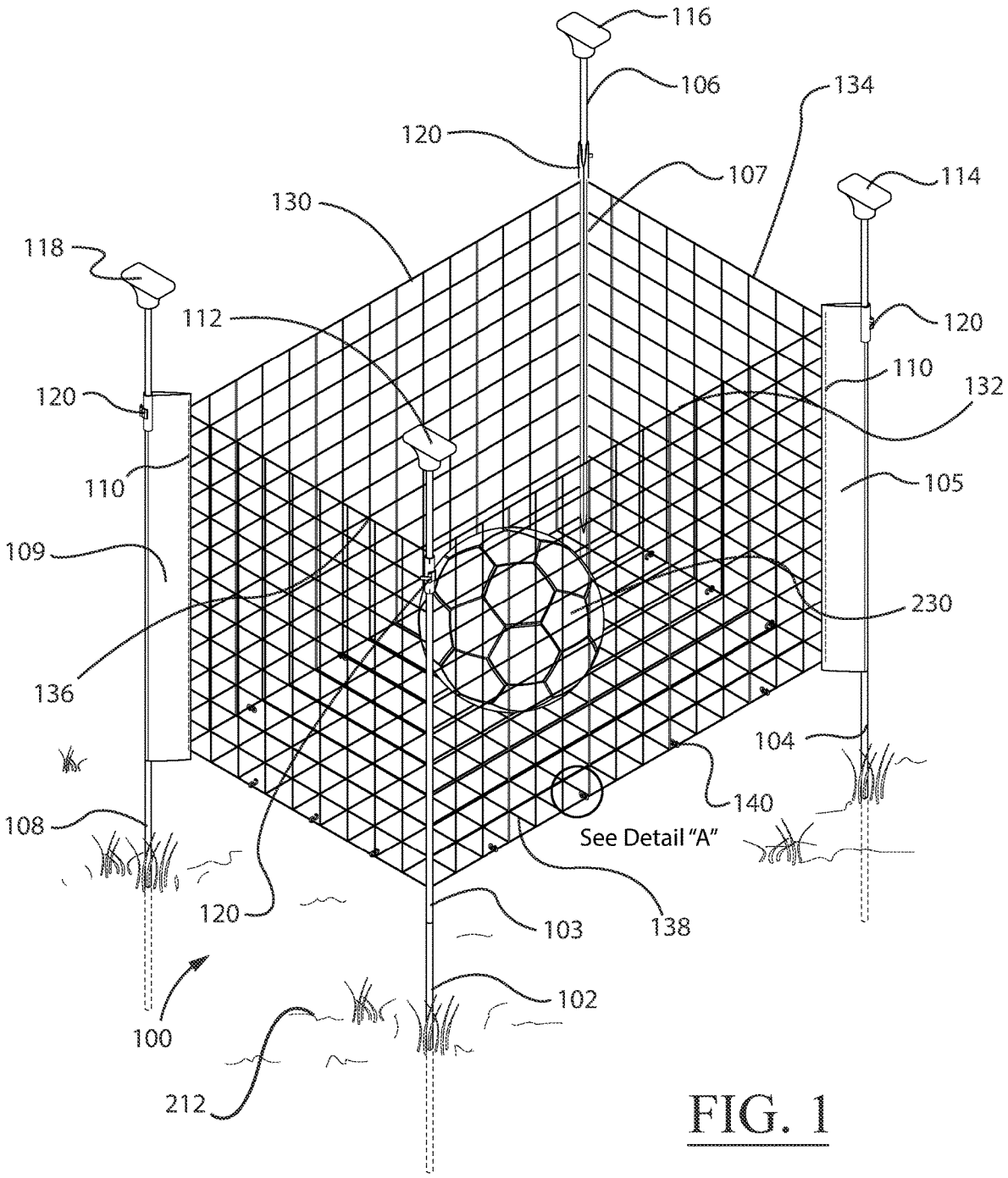
FIG. 1 is a perspective view of a soccer juggling training net, according to a first illustrative embodiment of the invention, wherein the soccer juggling training net is configured for outdoor use.
Figure 2:
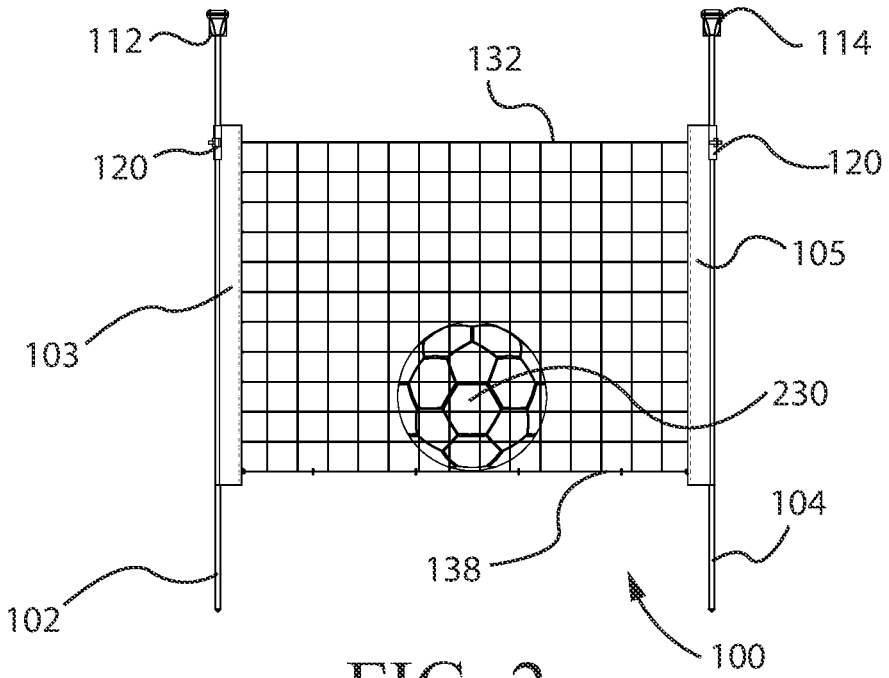
FIG. 2 is a first side view of the soccer juggling training net of FIG. 1.
Figure 3:
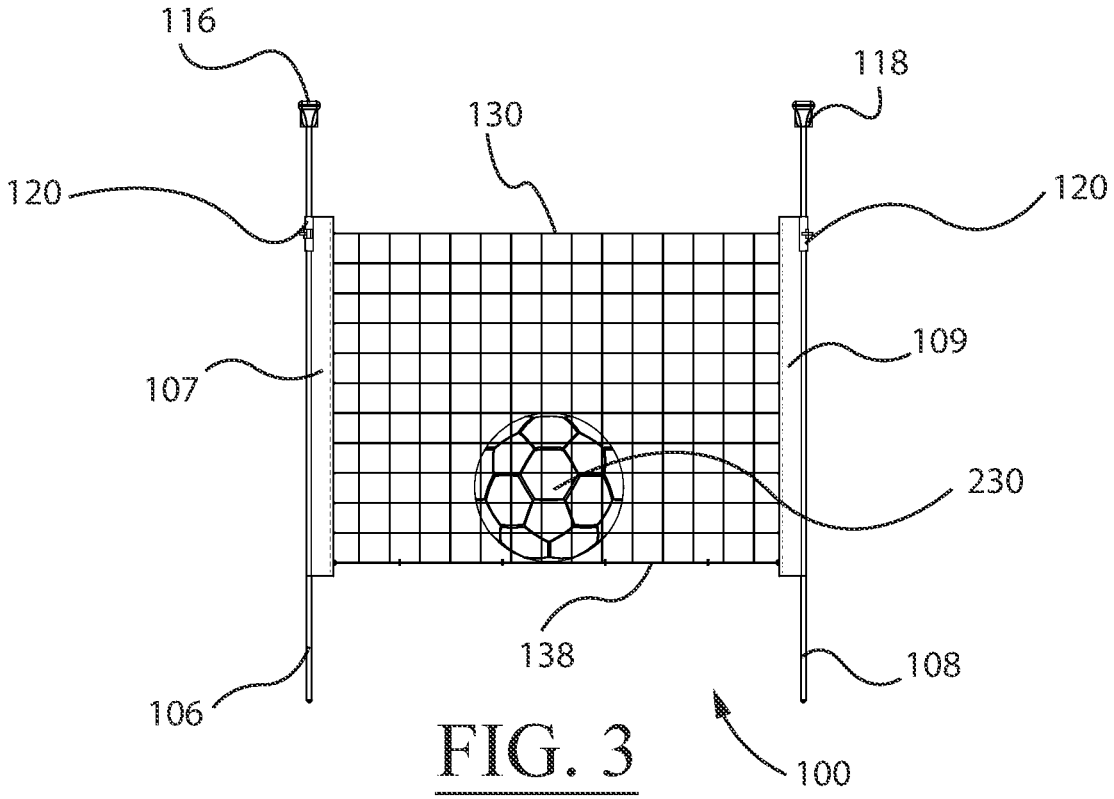
FIG. 3 is a second side view of the soccer juggling training net of FIG. 1.
Figure 4:
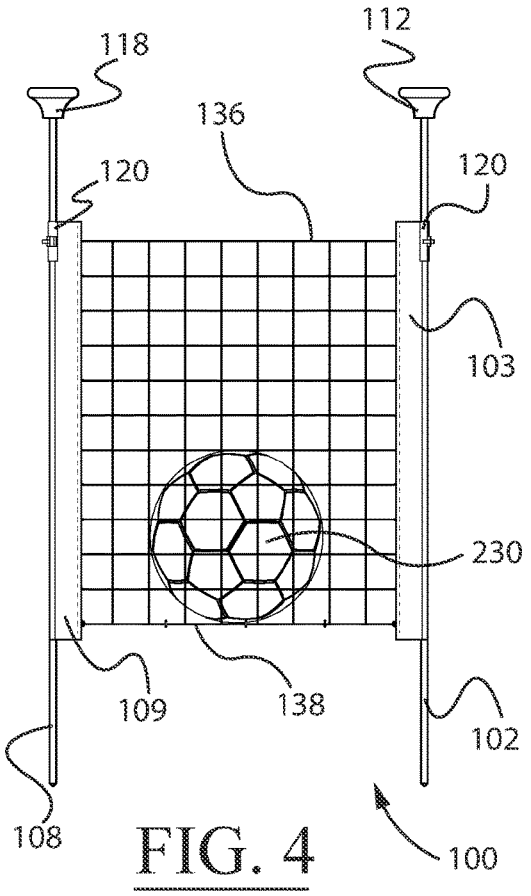
FIG. 4 is a first end view of the soccer juggling training net of FIG. 1.
Figure 5:
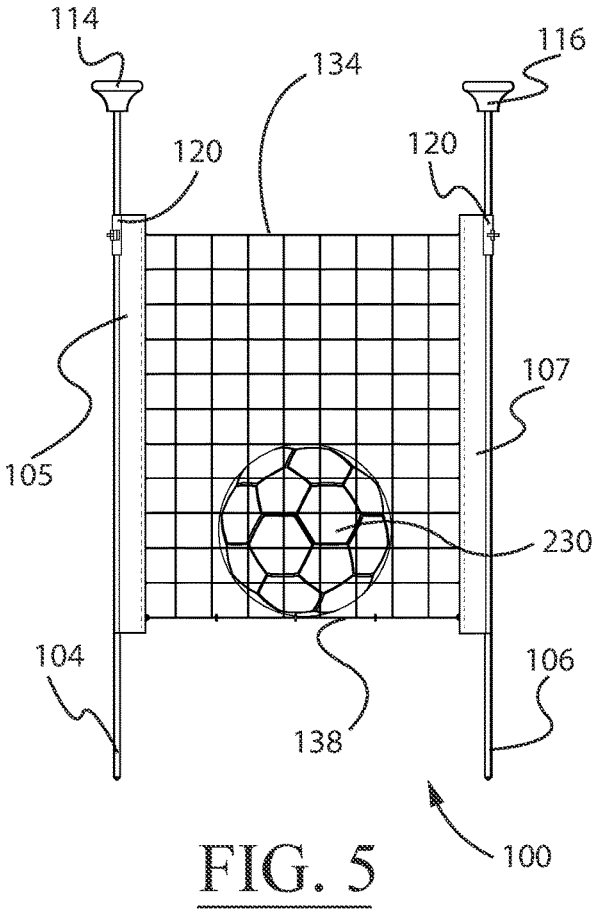
FIG. 5 is a second end view of the soccer juggling training net of FIG. 1.
Figure 6:
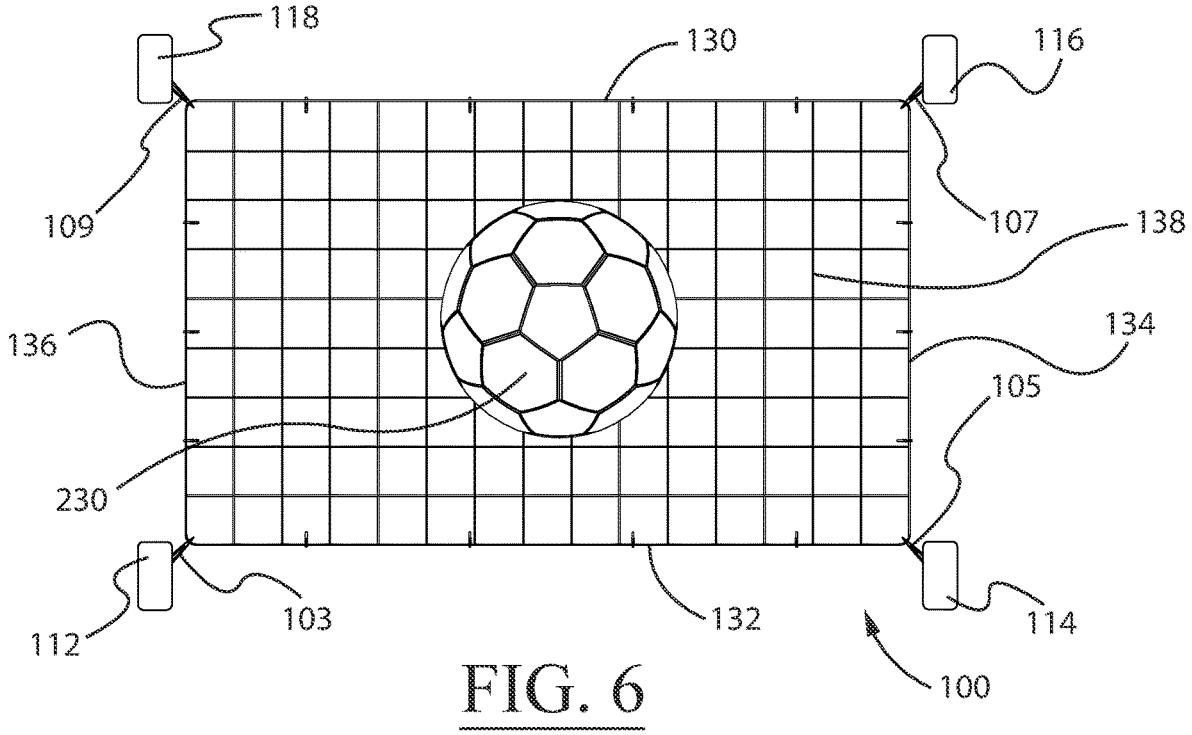
FIG. 6 is a top plan view of the soccer juggling training net of FIG. 1.
Figure 7:
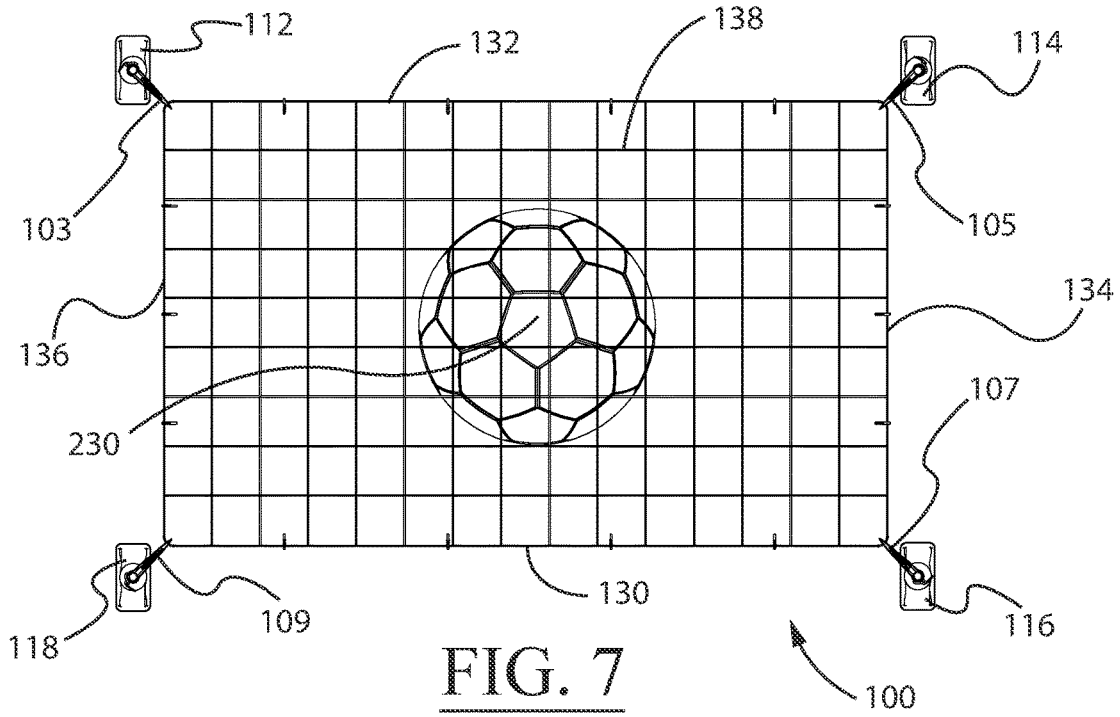
FIG. 7 is a bottom plan view of the soccer juggling training net of FIG. 1.
Figures 12, 13, 14:
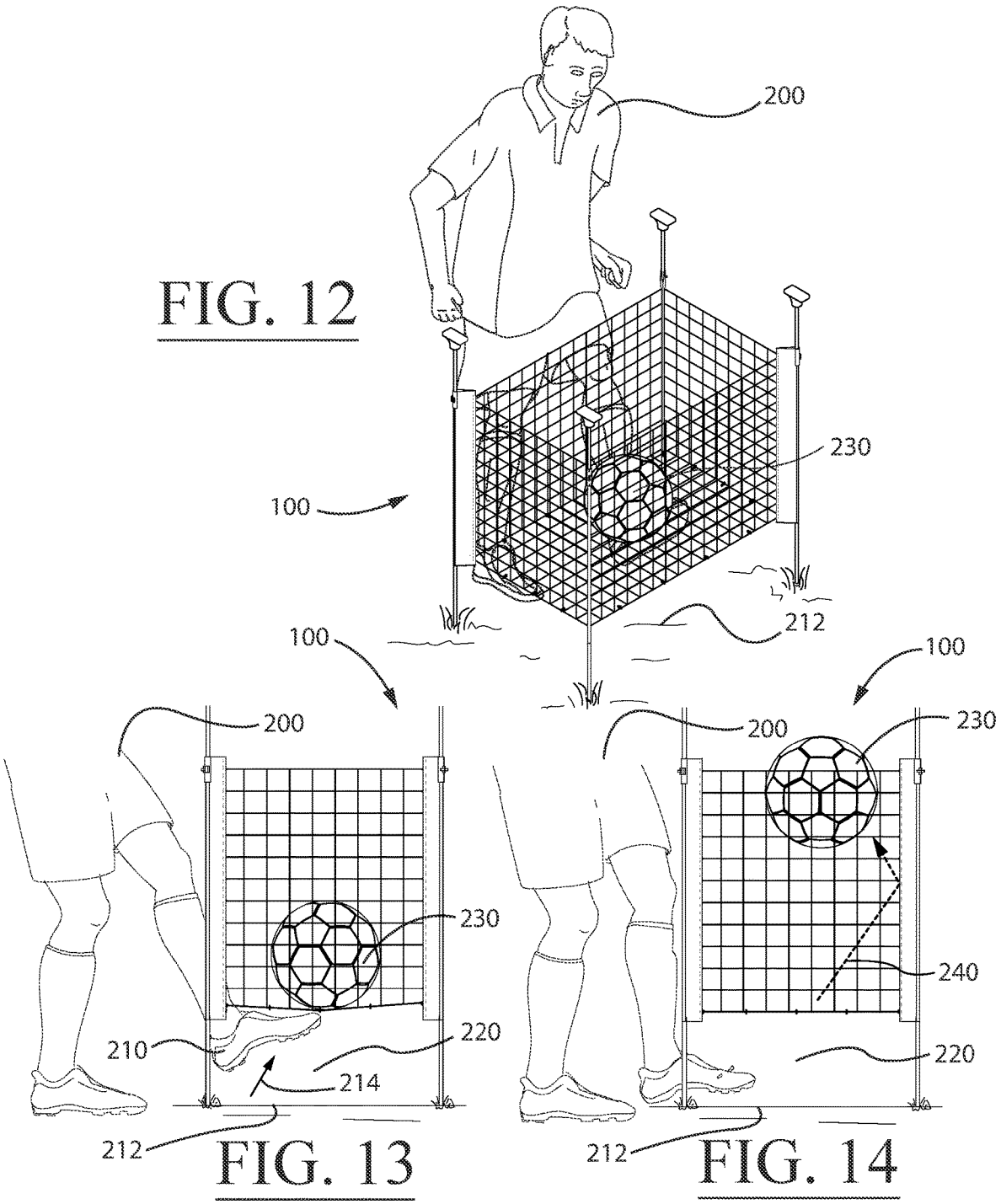
FIG. 12 is a perspective view illustrating a user kicking a soccer ball disposed inside the soccer juggling training net of FIG. 1.
FIG. 13 is a side view illustrating a user kicking the soccer ball disposed inside the soccer juggling training net of FIG. 1.
FIG. 14 is another side view illustrating a displacement path of the soccer ball inside the soccer juggling training net of FIG. 1 after the ball has been kicked by the user.
Figure 17:
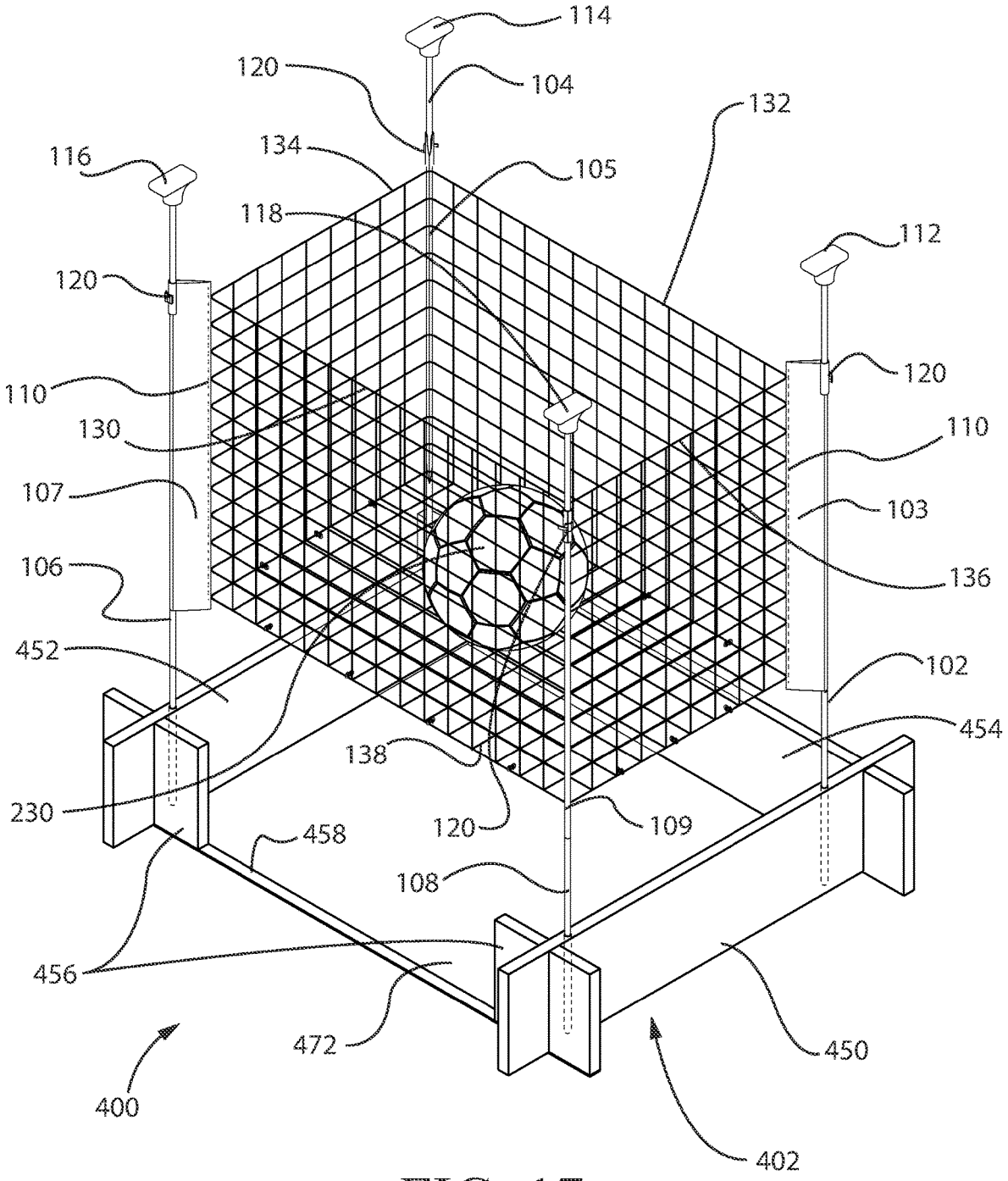
FIG. 17 is a perspective view of a soccer juggling training net, according to a second illustrative embodiment of the invention, wherein the soccer juggling training net is configured for indoor use.
Figure 19:
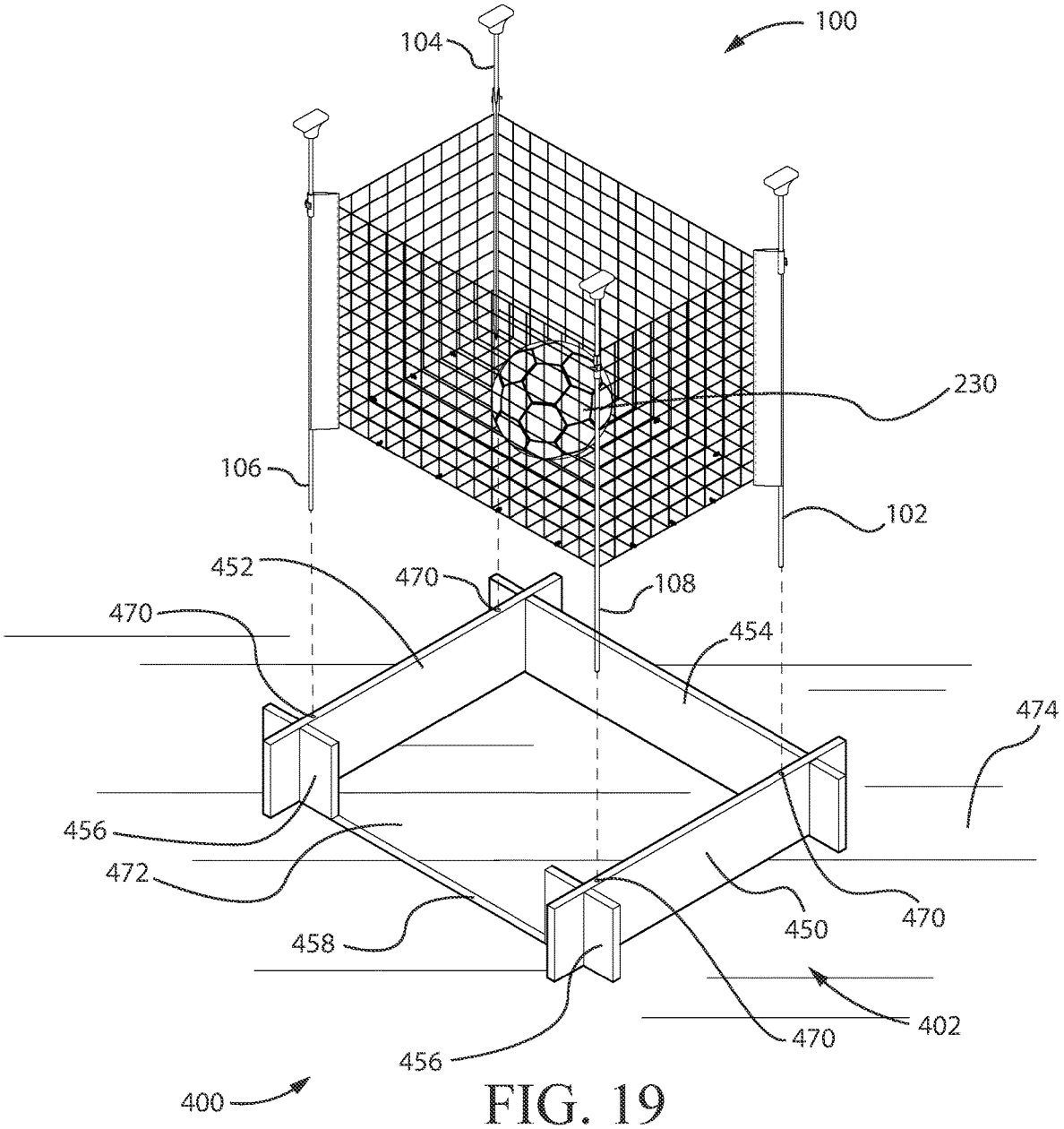
FIG. 19 is another perspective view of the soccer juggling training net of FIG. 17, wherein the soccer juggling training net has been exploded from the base member that is resting on a support surface.

A first illustrative embodiment of a soccer juggling training net is seen generally at 100 in FIGS. 1-8. As will be explained in more detail hereinafter, the soccer juggling training net 100 depicted in FIG. 1 is configured for outdoor use (i.e., the net 100 is configured to be staked into the ground 212). In the illustrative embodiment, referring initially to FIGS. 1 and 8, the soccer juggling training net 100 generally comprises a bottom net portion 138; a plurality of net side portions 130, 132, 134, 136 attached to the bottom net portion 138 so as to define a semi-enclosed or enclosed space for juggling a soccer ball 230; and a plurality of support post members 102, 104, 106, 108 coupled to one or more of the plurality of net side portions 130, 132, 134, 136. The semi-enclosed or enclosed space defined by the plurality of net side portions 130, 132, 134, 136 and the bottom net portion 138 constrains a movement of the soccer ball 230 while a user 200 is practicing the juggling of the soccer ball 230 (see FIGS. 12-15) so as to obviate a need for a retrieval of the soccer ball 230 by the user 200, but still providing sufficient freedom of movement of the soccer ball 230 so as to permit effective juggling training by the user 200. In the illustrative embodiment, the plurality of support post members 102, 104, 106, 108 are configured to be inserted into the ground (as shown in FIGS. 1 and 12) or into a base member 402 (as shown in FIGS. 17 and 19) so that the soccer juggling training net 100 is maintained in a generally stationary position relative to a support surface on which the soccer juggling training net 100 is disposed.

In the illustrative embodiment, with combined reference to FIGS. 1-7, it can be seen that the soccer juggling training net 100 comprises a first net side portion 130, a second net side portion 132, a third net side portion 134, and a fourth net side portion 136 attached to the bottom net portion 138. As shown in these figures, the first net side portion 130 is joined to the adjacent third net side portion 134 and the adjacent fourth net side portion 136 at respective approximate 90-degree angles, and the first net side portion 130 is joined to the bottom net portion 138 at an approximate 90-degree angle. The second net side portion 132 is joined to the adjacent third net side portion 134 and the adjacent fourth net side portion 136 at respective approximate 90-degree angles, and the second net side portion 130 is joined to the bottom net portion 138 at an approximate 90-degree angle. The third net side portion 134 is joined to the adjacent first net side portion 130 and the adjacent second net side portion 132 at respective approximate 90-degree angles, and the third net side portion 134 is joined to the bottom net portion 138 at an approximate 90-degree angle. The fourth net side portion 136 is joined to the adjacent first net side portion 130 and the adjacent second net side portion 132 at respective approximate 90-degree angles, and the fourth net side portion 136 is joined to the bottom net portion 138 at an approximate 90-degree angle. As such, in the illustrative embodiment of FIG. 1, the net side portions 130, 132, 134, 136 and the bottom net portion 138 collectively form a rectangular semi-enclosed space for juggling a soccer ball 230 where the space has an open top.

Figure 8:
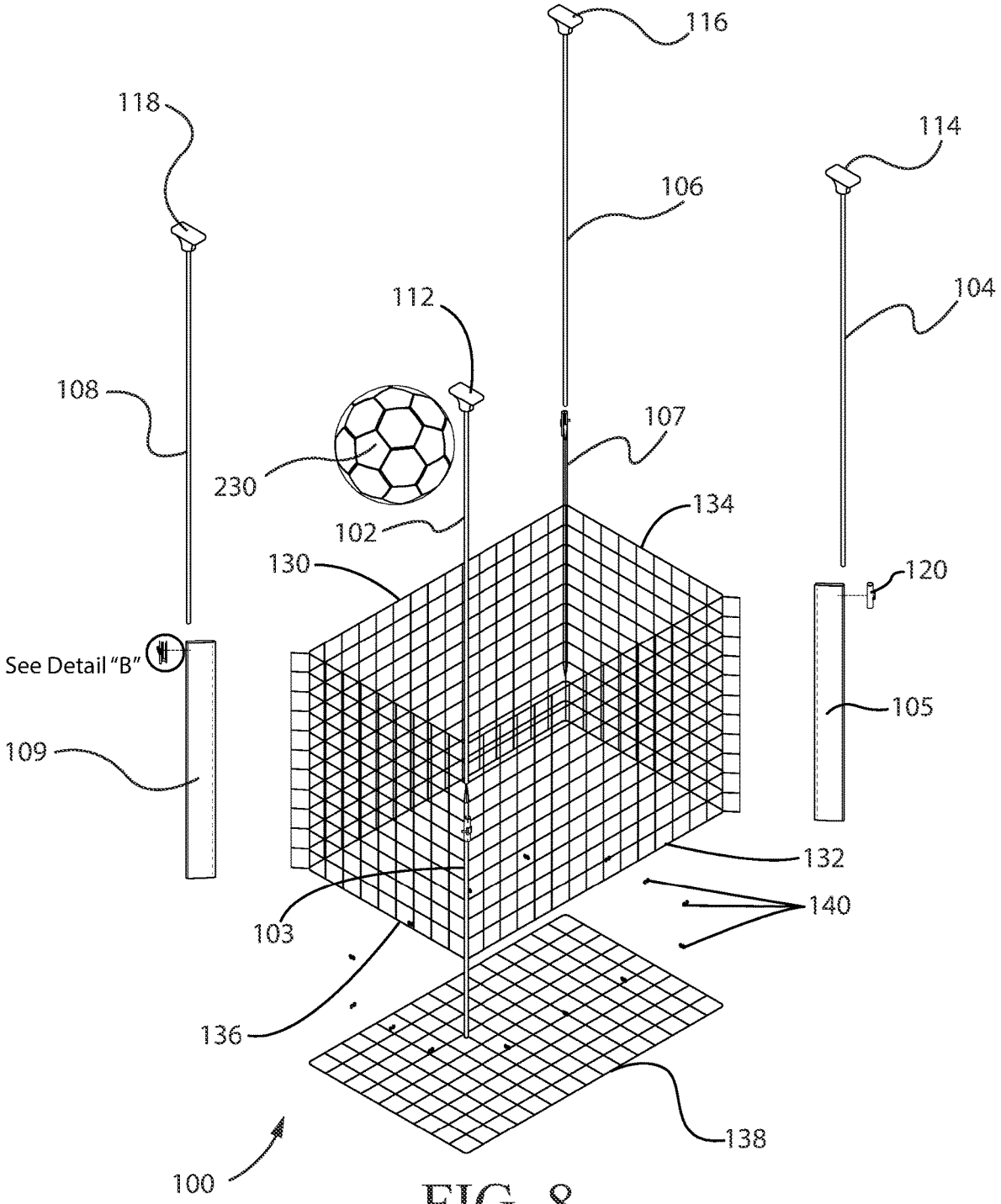
FIG. 8 is an exploded perspective view of the soccer juggling training net of FIG. 1.
Figure 9:
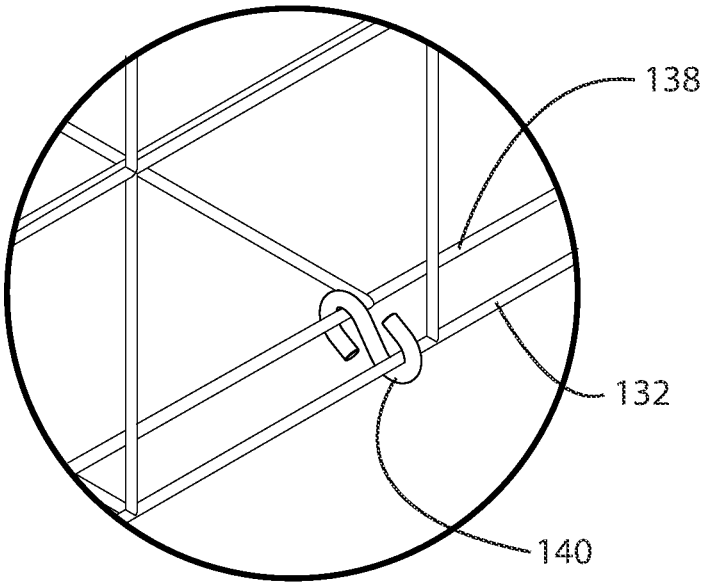
FIG. 9 is an enlarged perspective view illustrating a hook member attaching the bottom net portion to one of the net side portions of the soccer juggling training net illustrated in FIG. 1 (Detail "A")

In the illustrative embodiment, with combined reference to FIGS. 1, 8, and 9, it can be seen that each of the net side portions 130, 132, 134, 136 is attached to the bottom net portion 138 by a plurality of hook members 140 (i.e., S-shaped hook members 140). A detail view of one of the hook members 140 attaching the second net side portion 132 to the bottom net portion 138 is shown in FIG. 9. In alternative embodiment, the net side portions 130, 132, 134, 136 may be attached to the bottom net portion 138 by a plurality of zip tie members or other suitable fastening means.

Referring again to the illustrative embodiment of FIGS. 1-7, it can be seen that the soccer juggling training net 100 comprises a first support post member 102, a second support post member 104, a third support post member 106, and a fourth support post member 108. As shown in the perspective view of FIG. 1, each of the support post members 102, 104, 106, 108 is disposed in a respective corner of the soccer juggling training net 100. As shown in FIGS. 2-5, in the illustrative embodiment, each of the support post members 102, 104, 106, 108 may comprise a pointed tip or semi-pointed tip so as to facilitate an insertion of the support post member 102, 104, 106, 108 into the ground 212. Also, as shown in FIGS. 1-8, in the illustrative embodiment, each of the support post members 102, 104, 106, 108 comprises a respective post handle cap 112, 114, 116, 118 disposed on an upper end of the support post member 102, 104, 106, 108 so as to facilitate an insertion of the support post member 102, 104, 106, 108 into the ground 212. Advantageously, the post handle caps 112, 114, 116, 118 enable the support post members 102, 104, 106, 108 to be more easily pushed into the ground 212.

With reference again to the illustrative embodiment of FIGS. 1-8, it can be seen that the soccer juggling training net 100 further comprises a first net support strip 103, a second net support strip 105, a third net support strip 107, and a fourth net support strip 109. As shown in FIG. 1, each of the net support strips 103, 105, 107, 109 is disposed in a respective one of the corners of the soccer juggling training net 100, and each of the net support strips 103, 105, 107, 109 is disposed between and attached to adjacent net side portions 130, 132, 134, 136. With combined reference to FIGS. 1 and 8, it can be seen that each of the net support strips 103, 105, 107, 109 defines a passageway or chute for receiving a respective one of the support post members 102, 104, 106, 108. In the illustrative embodiment, a predetermined width portion (e.g., a one (1) inch width) of the side netting may be folded over (see FIG. 8), and sandwiched within a respective one of the net support strips 103, 105, 107, 109. Then, the predetermined width portion of the side netting may be fixed in place within the net support strip 103, 105, 107, 109 by stitching 110 (see FIG. 1) or other suitable attachments means, such as an adhesive, etc.

Figure 10:
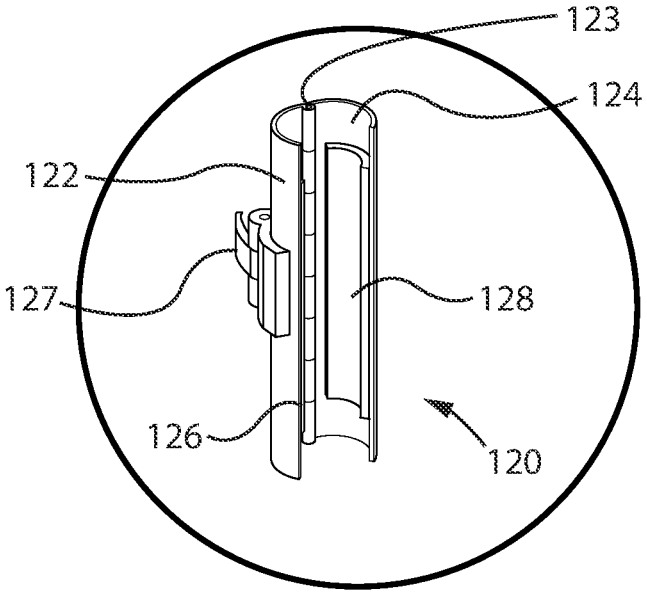
FIG. 10 is an enlarged perspective view illustrating one of the net clip assemblies of the soccer juggling training net illustrated in FIG. 1 (Detail "B")

In the illustrative embodiment, referring collectively to FIGS. 1, 8, and 10, it can be seen that the soccer juggling training net 100 further comprises a plurality of net clip assemblies 120. Each of the plurality of net clip assemblies 120 is configured to attach a respective one of the plurality of net support strips 103, 105, 107, 109 to respective adjacent net side portions 130, 132, 134, 136. In the illustrative embodiment, as shown in FIG. 10, each of the net clip assemblies 120 includes first and second clip body sections 122, 124 pivotally connected to one another by a central hinge 123. Each of the first and second clip body sections 122, 124 includes a respective rubber pad 126, 128 disposed on an inside surface thereof for compliably compressing a respective one of the net support strips 103, 105, 107, 109.

Figure 11:
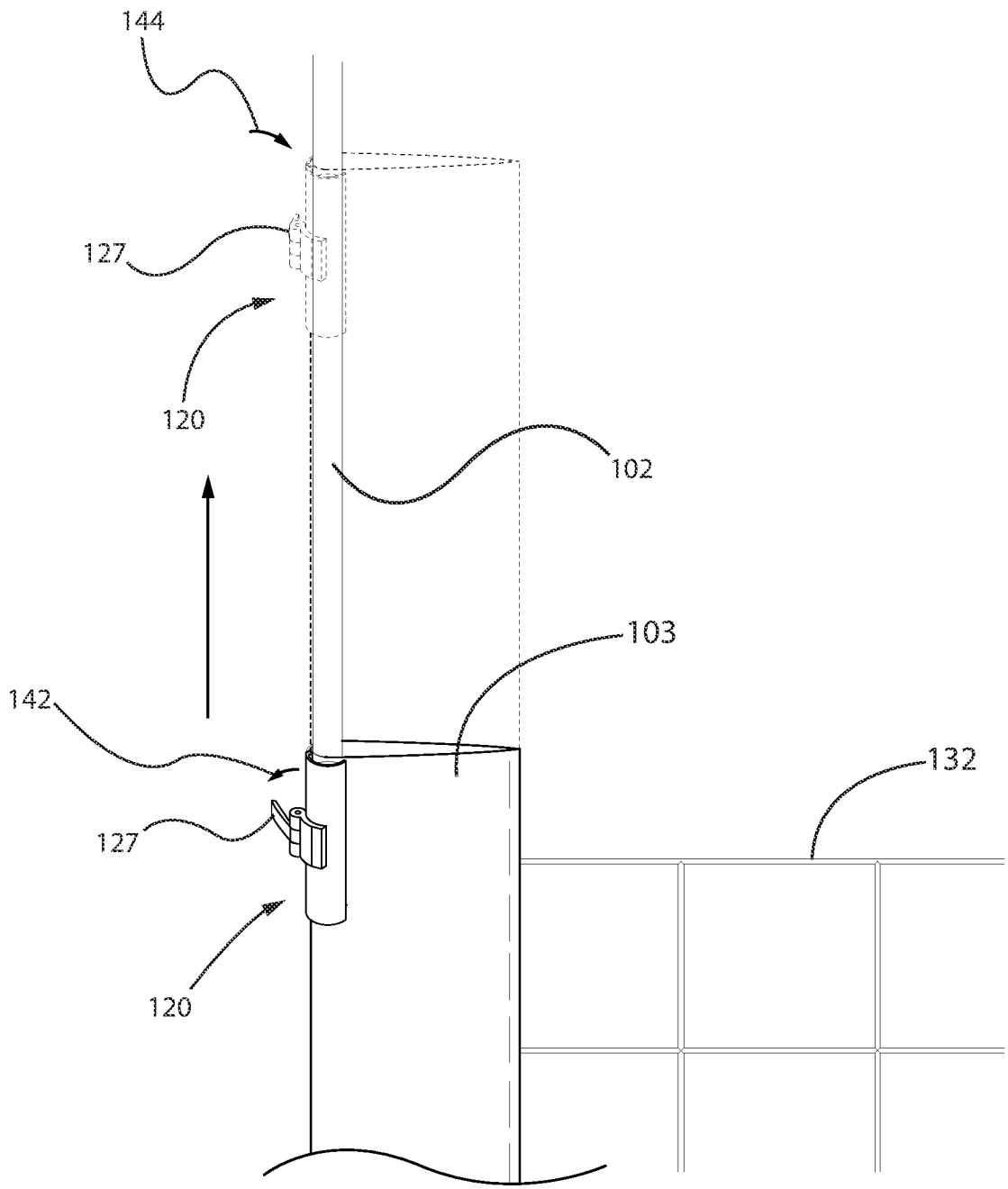
FIG. 11 illustrates the sliding adjustment of one of the net support strips on its respective support post member for adjusting a gap clearance of the soccer juggling training net illustrated in FIG. 1.

Also, in the illustrative embodiment, each of the net clip assemblies 120 comprises a releasable locking mechanism (e.g., a flip lock 127) for allowing the net support strips 103, 105, 107, 109 to be slid along the length of one of the plurality of support post members 102, 104, 106, 108 (e.g., as illustrated in FIG. 11). Advantageously, the slidable nature of the net support strips 103, 105, 107, 109 along their respective support post members 102, 104, 106, 108 allows the height of the soccer juggling training net 100 relative to the ground 212 to be adjusted (i.e., the gap 220 under the training net 100 to be adjusted—see FIGS. 13-15). As illustrated in FIG. 11, when a user wants to slide the net support strip 103, 105, 107, 109 along its respective support post members 102, 104, 106, 108, he or she rotates the handle of the releasable locking mechanism 127 in a first direction (e.g., counter-clockwise) to its unlocked position (as diagrammatically represented in FIG. 11 by the curved arrow 142), and then slides the net support strip 103, 105, 107, 109 along the length of its respective support post member 102, 104, 106, 108. After the desired position of the net support strip 103, 105, 107, 109 on the respective support post member 102, 104, 106, 108 is achieved, the user rotates the handle of the releasable locking mechanism 127 in a second, opposite direction (e.g., clockwise) to its locked position (as diagrammatically represented in FIG. 11 by the curved arrow 144).

Figure 15:
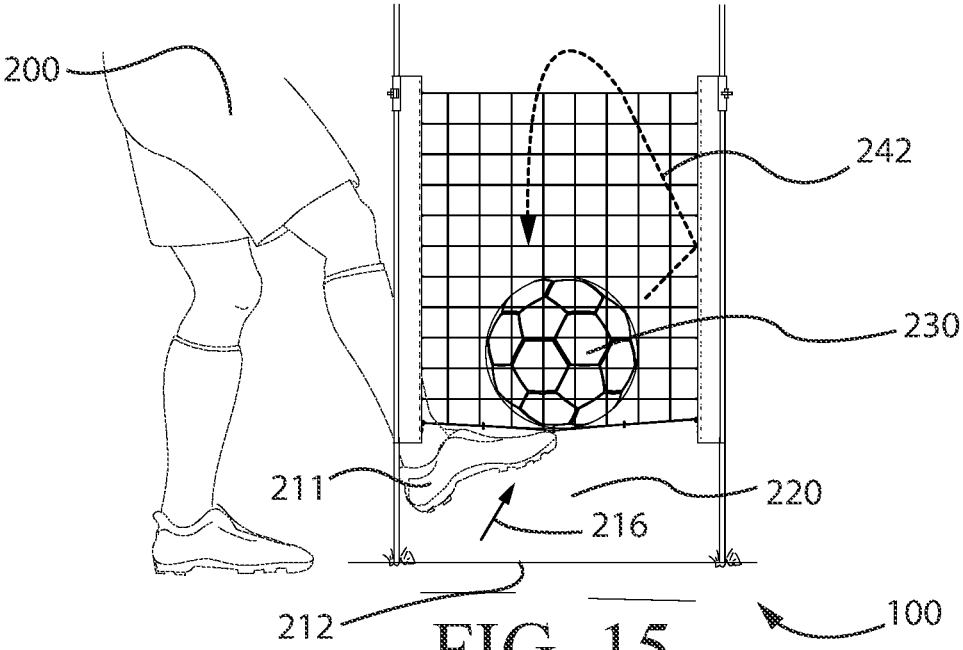
FIG. 15 is yet another side view illustrating a user kicking the soccer ball disposed inside the soccer juggling training net of FIG. 1.

As shown in FIGS. 1 and 12-15, the support post members 102, 104, 106, 108 are configured to be inserted a predetermined depth (e.g., six (6) inches) into the ground so as to define a clearance gap 220 between an upper surface of the ground 212 and the bottom net portion 138. In FIGS. 12, 13, and 15, it can be seen that the clearance gap 220 allows the user 200 to kick the soccer ball 230 from underneath the bottom net portion 138.

Referring to FIGS. 12-15, it can be seen that the soccer juggling training net 100 constrains a movement of the soccer ball 230 so that the user 200 is able to effectively practice the juggling of the ball 230 without the need for retrieving the ball 230 after errant kicks. In FIG. 13, the user 200 is kicking the soccer ball 230 upward with his left foot 210 as diagrammatically represented by the arrow 214. In FIG. 14, the upward displacement path of the soccer ball 230 is diagrammatically indicated by the arrow 240 after the ball 230 has been kicked by the user 200. In FIG. 15, the user 200 is kicking the soccer ball 230 upward with his right foot 211 as diagrammatically represented by the arrow 216. The upward displacement and return path of the soccer ball 230 is diagrammatically indicated by the arrow 242 in FIG. 15 after the ball 230 has been kicked by the user 200. As shown in this figure, the soccer juggling training net 100 is advantageously designed so that, after being kicked upwardly by the user 200, the soccer ball 230 is designed to return to the approximate middle portion of the net 100, and seat itself in the middle of the net 100.

Figure 16:
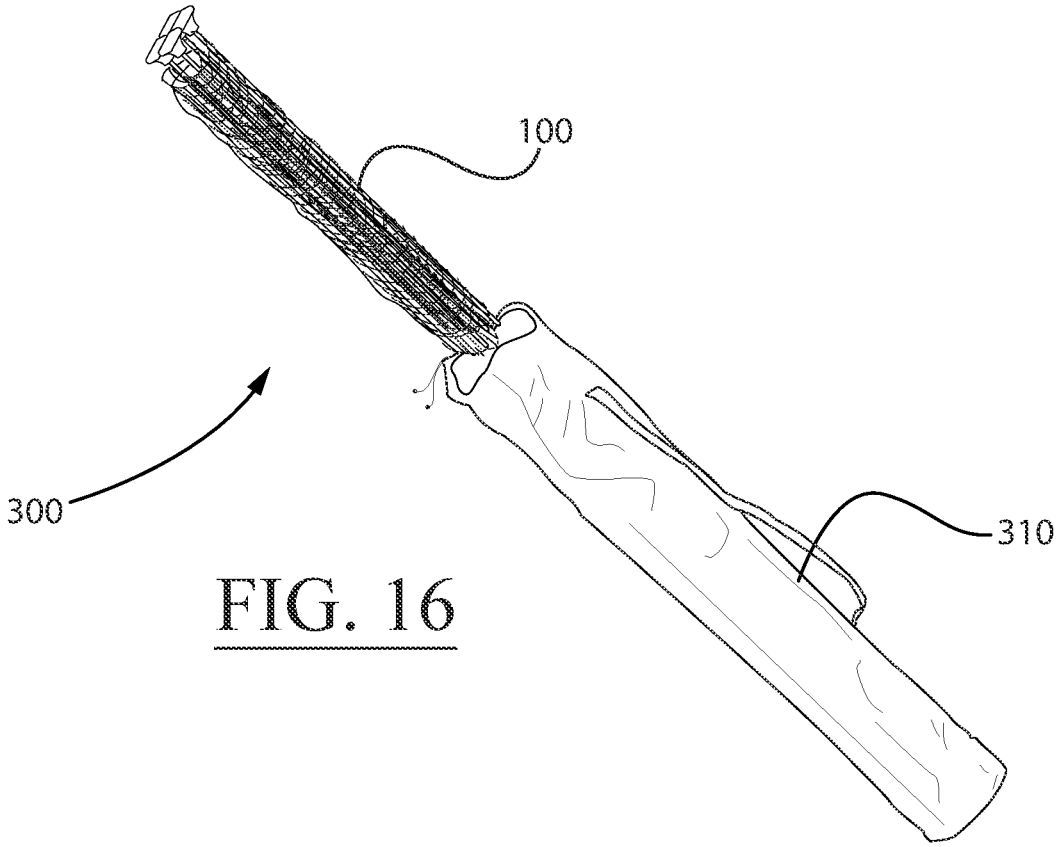
FIG. 16 is a perspective view of a collapsed form of the soccer juggling training net of FIG. 1 being inserted into a storage bag.

In the illustrative embodiment, after the soccer juggling training net 100 is done being used, the net 100 is configured to be collapsed into a compact state 300 (e.g., by grouping the support post members 102, 104, 106, 108 together and wrapping the netting therearound—see FIG. 16). Once the soccer juggling training net 100 is in its collapsed state 300, the net 100 is then able to be stowed in an elongate storage bag 310 so that the soccer juggling training net 100 is capable of being easily transported and stored. The elongate storage bag 310 may have a drawstring for closing the top end of the elongate storage bag 310.

A second illustrative embodiment of the soccer juggling training net is seen generally at 400 in FIGS. 17-20. Referring to these figures, it can be seen that, in many respects, the second illustrative embodiment is similar to that of the first illustrative embodiment. Moreover, many elements are common to both such embodiments. For the sake of brevity, the elements that the second embodiment of the soccer juggling training net has in common with the first embodiment will not be discussed because these components have already been described above.

Figure 18:
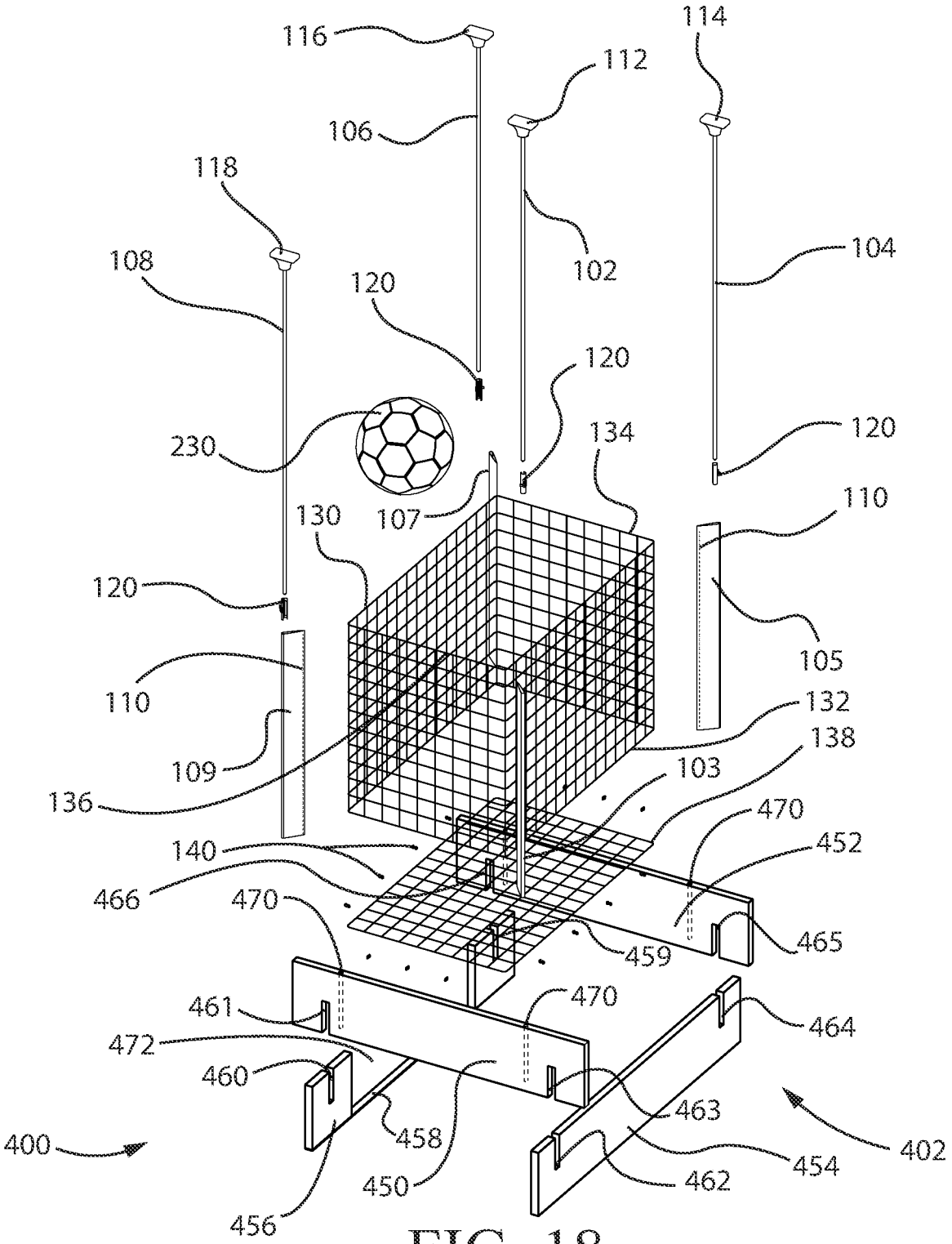
FIG. 18 is an exploded perspective view of the soccer juggling training net of FIG. 17.

Unlike the first illustrative embodiment of the soccer juggling training net 100 described above, the second illustrative embodiment of the soccer juggling training net 400 is configured for indoor use, rather than outdoor use. As shown in FIGS. 17-19, the soccer juggling training net 400 further comprises a base frame 402 for supporting the soccer juggling training net 400 on a floor 474 of a building (e.g., on a concrete floor, carpeting, artificial turf, wood or vinyl flooring, etc.—see FIG. 19). As shown in these figures, the base frame 402 comprises a plurality of side members 450, 452, 454, 456 connected to one another. More specifically, the base frame 402 includes a first side member 450, a second side member 452, a third side member 454, and a fourth side member 456. The first side member 450 is joined to the adjacent third side member 454 and the adjacent fourth side member 456 at respective approximate 90-degree angles. As shown in FIG. 18, the first side member 450 has a downwardly facing slot 463 that engages with an upwardly facing slot 462 in the third side member 454, and the first side member 450 has a downwardly facing slot 461 that engages with an upwardly facing slot 460 in the fourth side member 456. The second side member 452 is joined to the adjacent third side member 454 and the adjacent fourth side member 456 at respective approximate 90-degree angles. As shown in FIG. 18, the second side member 452 has a downwardly facing slot 465 that engages with an upwardly facing slot 464 in the third side member 454, and the second side member 452 has a downwardly facing slot 466 that engages with an upwardly facing slot 459 in the fourth side member 456.

With combined reference to FIGS. 18 and 19, in the illustrative embodiment, it can be seen that the first side member 450 and the second side member 452 each comprise a pair of spaced-apart holes 470 disposed in upper surfaces thereof for enabling the support post members 102, 104, 106, 108 to be inserted into the base frame 402 (as diagrammatically indicated by the dashed lines in FIG. 19). As such, the same components used for the outdoor version of the soccer juggling training net 100 described above can be advantageously used for the indoor version of the soccer juggling training net 400 depicted in FIGS. 17-19 because the distal end portions of the support post members 102, 104, 106, 108 are simply inserted into the holes 470 of the base frame 402, rather than into the ground 212.

Referring again to FIGS. 17-19, in the illustrative embodiment, it can be seen that the fourth side member 456 of the base frame 402 defines a foot opening 472 for allowing the user to kick the soccer ball 230 from underneath the bottom net portion 138. As shown in these figures, the two frame portions of the fourth side member 456, which are disposed on opposite sides of the foot opening 472, are connected to one another by strip connector member 458. In the illustrative embodiment, the strip connector member 458 may be in the form of a generally rigid or semi-rigid metallic strip.

Figure 20:
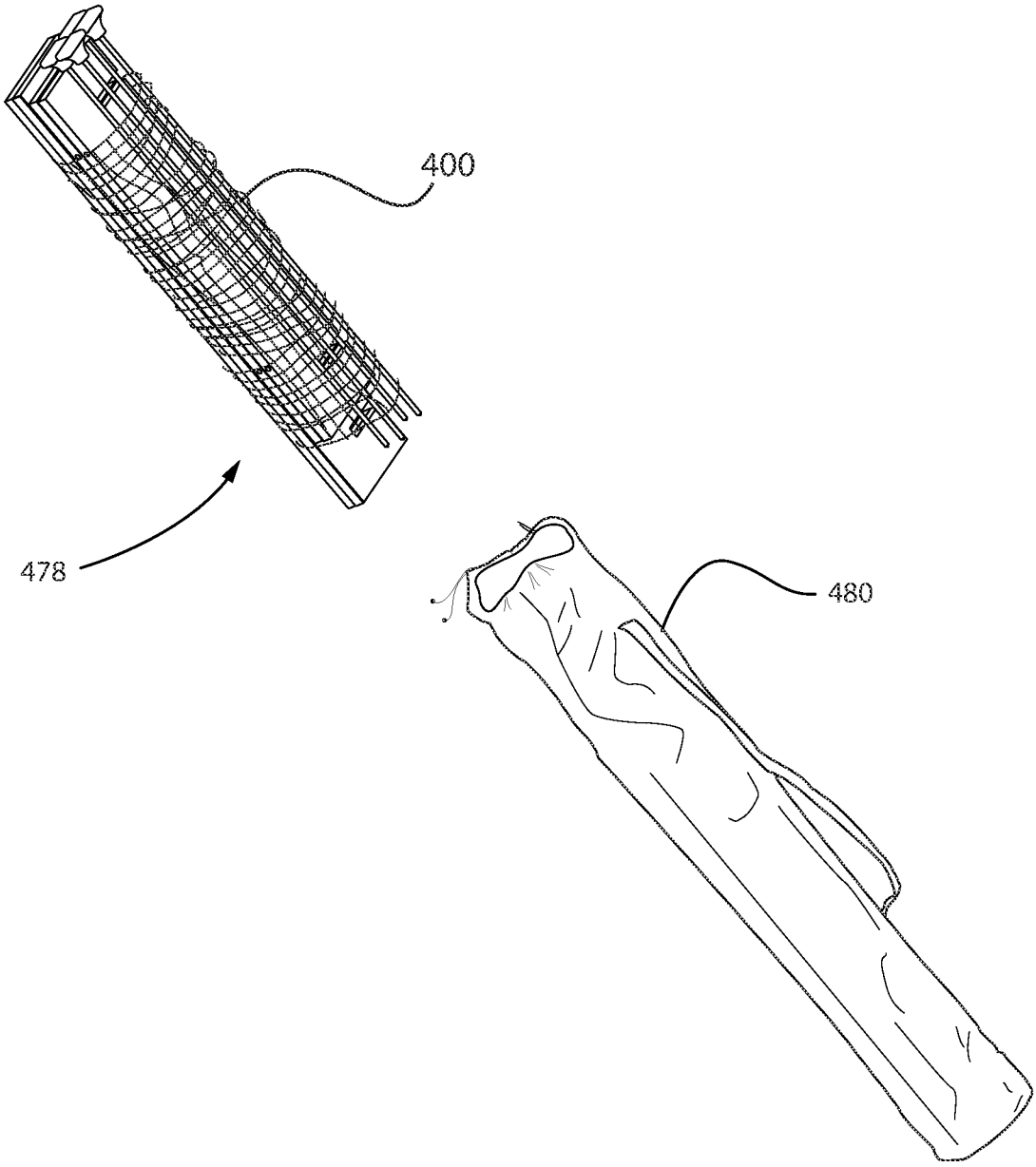
FIG. 20 is a perspective view of a collapsed form of the soccer juggling training net of FIG. 17 being inserted into a storage bag.

Similar to the first illustrative embodiment of the soccer juggling training net 100 described above, in the second illustrative embodiment, after the soccer juggling training net 400 is done being used, the net 400 is configured to be collapsed into a compact state 478 (e.g., by grouping the support post members 102, 104, 106, 108 and the base frame side members 450, 452, 454, 456 together and wrapping the netting therearound—see FIG. 20). Once the soccer juggling training net 400 is in its collapsed state 478, the net 400 is then able to be stowed in an elongate storage bag 480 so that the soccer juggling training net 400 is capable of being easily transported and stored. The elongate storage bag 480 may have a drawstring for closing the top end of the elongate storage bag 480.

Figure 21:
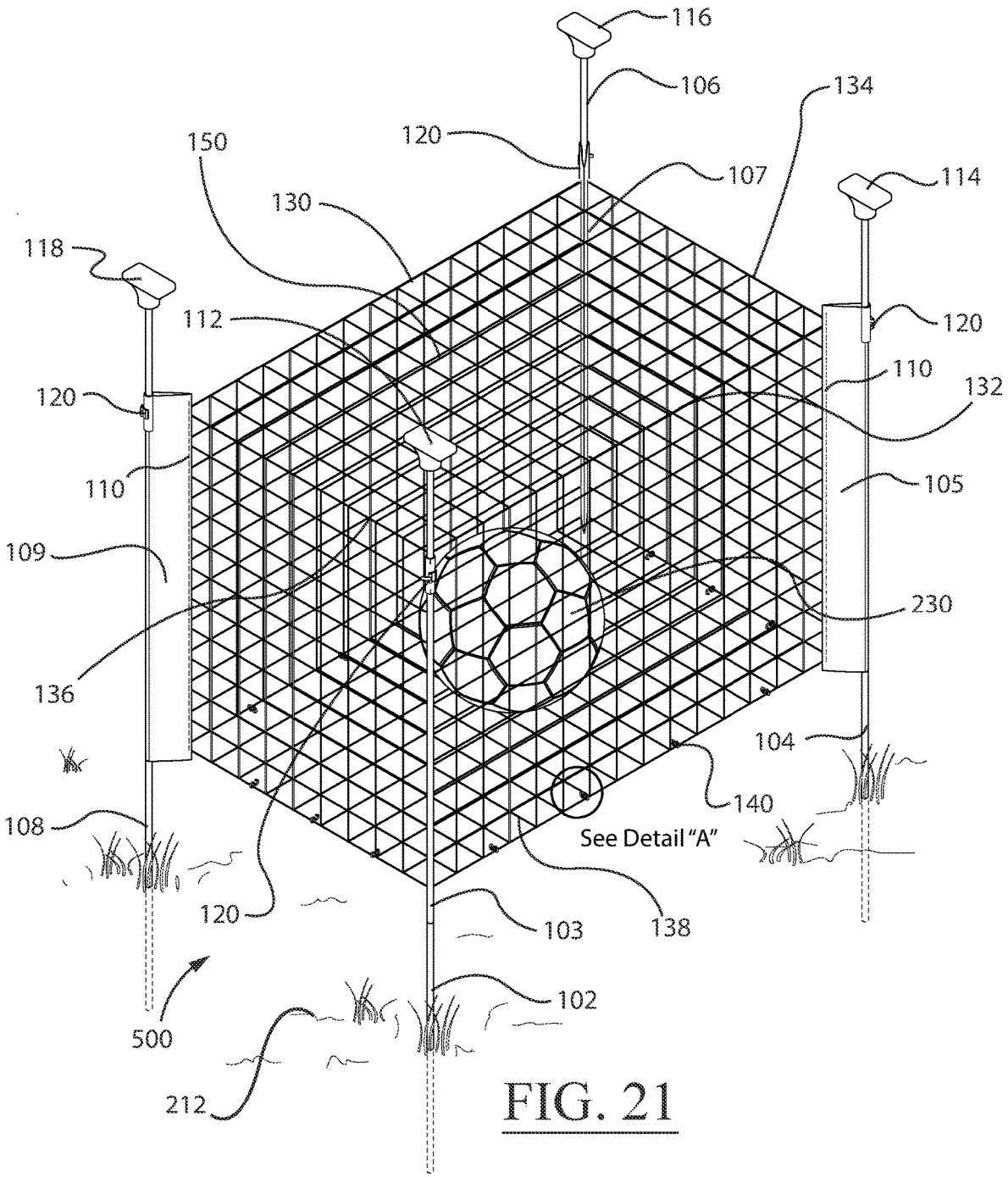
FIG. 21 is a perspective view of a soccer juggling training net, according to a third illustrative embodiment of the invention, wherein the soccer juggling training net is configured for outdoor use, and is provided with a top net portion.

A third illustrative embodiment of the soccer juggling training net is seen generally at 500 in FIG. 21. Referring to this figure, it can be seen that, in many respects, the third illustrative embodiment is similar to that of the first illustrative embodiment. Moreover, many elements are common to both such embodiments. For the sake of brevity, the elements that the third embodiment of the soccer juggling training net has in common with the first embodiment will not be discussed because these components have already been described above.

As shown in FIG. 21, the soccer juggling training net 500 is similar in most respects to the soccer juggling training net 100 described above, except that the soccer juggling training net 500 further comprises a top net portion 150 attached to the plurality of net side portions 130, 132, 134, 136 so as to define an enclosed space for juggling the soccer ball 230. As described above for the bottom net portion 138, the top net portion 150 may be attached to each of the net side portions 130, 132, 134, 136 by a plurality of hook members (e.g., S-shaped hook members 140). In an alternative embodiment, the net side portions 130, 132, 134, 136 may be attached to the top net portion 150 by a plurality of zip tie members or other suitable fastening means.

It is readily apparent that the aforedescribed soccer juggling training net 100, 400, 500 offers numerous advantages. First, the soccer juggling training net 100, 400, 500 holds a soccer ball in a confined space while players develop their juggling skills. Secondly, the soccer juggling training net 100, 400, 500 creates a defined space where a player can access and feel the ball through the net without the ball careening out of control on errant kicks. Finally, the soccer juggling training net 100, 400, 500 allows players to improve their juggling ability, build muscle and proper muscle memory, and develop the touch required for superior passing, receiving, and volleying of a soccer ball.

In the illustrative embodiments described above, the soccer juggling training net 100, 400, 500 essentially operates as training wheels for juggling a soccer ball. Just as training wheels hold the rider upright while they develop balance on a bicycle, the soccer juggling training net 100, 400, 500 holds the soccer ball in a confined space, while the player develops touch and coordination. Using netting 130, 132, 134, 136, and 138 around a plurality of support posts (e.g., ground spikes) that go into the ground, a defined space is created where the player can access and feel the ball through the net without it careening out of control on errant kicks. The player is encouraged by immediate success and improvement as they are able to deliver multiple kicks to the ball without interruption. Proper technique is rewarded and important muscle building occurs automatically. The soccer juggling training net 100, 400, 500 allows the young player to use both feet right from the start instead of falling into the trap of just using their dominant foot. A row of soccer juggling training nets 100, 400, 500 allows a coach to monitor and productively oversee a row of young players while running drills with another set of players. The tension of the net 130, 132, 134, 136, and 138 is adjustable as is the height and ground clearance for different sized players and personal preference.

In the illustrative embodiments described above, the soccer juggling training net 100, 400, 500 offers the ability to move indoors as weather and daylight dictates. The plurality of support posts (e.g., ground spikes) slide into a base frame 402 that holds the net 130, 132, 134, 136, and 138 for indoor practice. In one or more illustrative embodiments, there is a top net 150 that fastens or snaps into place to contain the soccer ball to protect indoor furnishings. Players are able to continue their training and advancement year-round and get their daily touches in without breaks in their practice.

Thus, it is apparent that the soccer juggling training net 100, 400, 500 is an invaluable tool for soccer players of all levels of ability that desire to improve their juggling ability, build muscle and proper muscle memory, and develop the touch required for superior passing, receiving, and volleying of the soccer ball.

Any of the features or attributes of the above-described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A soccer juggling training net, comprising:

a bottom net portion;

a plurality of net side portions attached to the bottom net portion so as to define a semi-enclosed or enclosed space for juggling a soccer ball, the semi-enclosed or enclosed space defined by the plurality of net side portions and the bottom net portion constraining a movement of the soccer ball while a user is practicing the juggling of the soccer ball so as to obviate a need for a retrieval of the soccer ball by the user, but still providing sufficient freedom of movement of the soccer ball so as to permit effective juggling training by the user;

one or more support post members coupled to one or more of the plurality of net side portions, at least one of the one or more support post members comprising a pointed tip so as to facilitate an insertion of the support post member into the ground; and a base member for supporting the soccer juggling training net on a floor of a building, the base member comprising a plurality of planar side members connected to one another, one or more of the plurality of planar side members comprising holes disposed in upper surfaces thereof for enabling the one or more support post members to be inserted into the base member;

wherein the one or more support post members are configured to be interchangeably inserted into the ground or into the base member so that the soccer juggling training net is maintained in a generally stationary position relative to an outdoor support surface or an indoor support surface on which the soccer juggling training net is disposed.

2. The soccer juggling training net according to claim 1, wherein adjacent ones of the plurality of net side portions are joined to one another at approximately 90-degree angles, and the bottom net portion is joined to the plurality of net side portions at approximately 90-degree angles.

3. The soccer juggling training net according to claim 1, wherein the one or more support post members comprise a plurality of support post members, each of the plurality of support post members being disposed in a respective corner of the soccer juggling training net.

4. The soccer juggling training net according to claim 3, wherein at least one of the plurality of support post members comprises a post handle cap disposed on an upper end of the support post member so as to facilitate an insertion of the support post member into the ground.

5. The soccer juggling training net according to claim 3, further comprising a plurality of net support strips, each of the plurality of net support strips disposed in a respective one of the corners of the soccer juggling training net, each of the plurality of net support strips being disposed between and attached to adjacent net side portions, and each of the plurality of net support strips defining a passageway for receiving a respective one of the plurality of support post members.

6. The soccer juggling training net according to claim 5, further comprising a plurality of net clip assemblies, each of the plurality of net clip assemblies configured to attach a respective one of the plurality of net support strips to respective adjacent net side portions.

7. The soccer juggling training net according to claim 6, wherein at least one of the plurality of net clip assemblies comprises a releasable locking mechanism for allowing one of the plurality of net support strips to be slid along the length of one of the plurality of support post members.

8. The soccer juggling training net according to claim 1, wherein the one or more support post members are configured to be inserted a predetermined depth into the ground so as to define a gap between an upper surface of the ground and the bottom net portion, the gap allowing the user to kick the soccer ball from underneath the bottom net portion.

9. The soccer juggling training net according to claim 1, wherein at least one of the plurality of planar side members of the base member defines a foot opening for allowing the user to kick the soccer ball from underneath the bottom net portion, the foot opening being bounded by two planar wall sections of the at least one of the plurality of planar side members and a strip connector member extending between the two planar wall sections of the at least one of the plurality of planar side members.

10. The soccer juggling training net according to claim 1, wherein the soccer juggling training net is configured to be collapsed into a compact state by grouping the one or more support post members and the plurality of planar side members of the base member together and wrapping the plurality of net side portions around the one or more support post members and the plurality of planar side members of the base member, and then the soccer juggling training net is configured to be stowed in an elongate storage bag so that the soccer juggling training net is able to be easily transported and stored.

11. The soccer juggling training net according to claim 1, further comprising a top net portion attached to the plurality of net side portions so as to define an enclosed space for juggling the soccer ball.

12. The soccer juggling training net according to claim 1, wherein the plurality of net side portions are attached to the bottom net portion by a plurality of hook members or a plurality of zip tie members.

13. A soccer juggling training net, comprising:

a bottom net portion;

a net side portion attached to the bottom net portion so as to define a semi-enclosed or enclosed space for juggling a soccer ball, the semi-enclosed or enclosed space defined by the net side portion and the bottom net portion constraining a movement of the soccer ball while a user is practicing the juggling of the soccer ball so as to obviate a need for a retrieval of the soccer ball by the user, but still providing sufficient freedom of movement of the soccer ball so as to permit effective juggling training by the user;

one or more support post members coupled to the net side portion, at least one of the one or more support post members comprising a pointed tip so as to facilitate an insertion of the support post member into the ground; and a base member for supporting the soccer juggling training net on a floor of a building, the base member comprising a plurality of planar side members connected to one another, one or more of the plurality of planar side members comprising holes disposed in upper surfaces thereof for enabling the one or more support post members to be inserted into the base member;

wherein the one or more support post members are configured to be interchangeably inserted into the ground or into the base member so that the soccer juggling training net is maintained in a generally stationary position relative to an outdoor support surface or an indoor support surface on which the soccer juggling training net is disposed, and the bottom net portion is configured to be elevated a predetermined height above the outdoor support surface or the indoor support surface so as to define a gap between the outdoor support surface and the bottom net portion or a gap between the indoor support surface and the bottom net portion, the gap allowing the user to kick the soccer ball from underneath the bottom net portion.

* * * * *